United States Patent [19]

Noe et al.

[11] Patent Number: 4,749,117

[45] Date of Patent: Jun. 7, 1988

[54] TUBE SHEET WELDING

[75] Inventors: Renato R. Noe, Union City, N.J.; Edward A. Fox, Glen Mills, Pa.

[73] Assignees: Public Service Electric and Gas Company, Newark, N.J.; ICI Americas, Inc., Wilmington, Del.

[21] Appl. No.: 846,966

[22] Filed: Apr. 1, 1986

[51] Int. Cl.[4] ..... B23K 20/08

[52] U.S. Cl. ..... 228/107; 228/2.5; 29/421 E; 29/157.4

[58] Field of Search ..... 29/157.4, 421 E; 228/107, 108, 109, 2.5

[56] References Cited

U.S. PATENT DOCUMENTS

| | | | |
|---|---|---|---|
| 3,698,067 | 10/1972 | Feiss | 228/107 |
| 3,717,925 | 2/1973 | Hardwick | 228/108 |
| 3,749,161 | 7/1973 | Hibbeler | 29/157.4 X |
| 3,774,291 | 11/1973 | Snyder | 29/421 E |
| 4,226,280 | 10/1980 | Hellouin de Cenival | 29/157.4 X |
| 4,527,623 | 7/1985 | Baird et al. | 228/109 X |

*Primary Examiner*—Kenneth J. Ramsey

*Attorney, Agent, or Firm*—Kenyon & Kenyon

[57] ABSTRACT

An improved method for the explosive expansion and welding of tubes to tube sheet includes trepanning the rear face of the tube sheet to form integral collars around each tube-receiving bore in the tube sheet. The collars prevent accumulation of corrosive material in a gap between the tube and tube sheet bore, and provide support to the tube wall when the tube is explosively expanded beyond the region of the tube surrounded by the collar.

11 Claims, 2 Drawing Sheets

TUBE SHEET WELDING

BACKGROUND OF THE INVENTION

The present invention relates to an improved method for the explosive welding and expanding of tubes to a tube sheet, and more particularly, to an improved method for the explosive welding and expanding of tubes to bottom tube sheets of vertically mounted heat exchangers, such as high pressure feedwater heaters and nuclear steam generators.

Known methods for joining tubes to tube sheets, which typically are plates several inches thick through which holes are drilled for receiving the ends of the tubes, include the use of a packing between the tube and the tube sheet, mechanically rolling-in a tube using a rolling or expanding tool, and gas or arc welding, all of which for various reasons commonly lead to tube failures. Failures in welding methods, for example, can be related both to the tube end geometry (e.g., tube protrusion, weld rollover) and weld characteristics (e.g., porosity, heat affected zone, residual stress).

Disadvantages of known methods for joining tubes to a tube sheet, including large heat affected zones in conventional welding techniques and relatively higher residual stresses from mechanically "tormenting" the tube material in rolling-in methods, led to the use of explosive welding and expanding methods, an example of which is disclosed in U.S. Pat. No. 3,503,110 to Berry et al. In an explosive welding and expanding method, the explosive energy released when an explosive charge is detonated in the tube results in shock waves travelling through the tube which expand the tube within the tube sheet bore and create a metallurgical bond between the contact faces of the outer surface of the tube and the inner surface of the bore over at least a portion of the tube length located within the tube sheet bore.

The welding of the tube within the tube sheet, in this and other known welding methods, often results in a gap (or crevice) at the tube and tube sheet juncture, either at the back of the tube weld (when the explosive charge is selected so that no expansion results) or at the back of the tube expansion within the tube sheet, i.e., between the outer surface of the tube and the inner surface of the tube sheet bore. These gaps lead to accumulation of deposits and/or inadequate drainage in the areas surrounding the tubes and form sites for corrosion, particularly in vertically arranged units, because the accumulation of deposits cannot be adequately blown down or drained from the face of the tube sheet.

Proposed solutions to the aforementioned problem of gapping at the tube and tube sheet juncture are disclosed in U.S. Pat. Nos. 3,698,067 and 3,790,060, both to Feiss. These patents disclose an apparatus and method for mounting a tube in a perforated sheet by means of explosive pressure waves, with the stated object of eliminating gap corrosion between the tube and tube sheet. In one embodiment, a tube is inserted in a bore of a perforated end plate of a heat exchanger for the full thickness of the plate. The inserted tube is provided with two collars to ensure that it is disposed concentrically in the bore. A portion of small diameter between one of the collars and the end of the tube is to be metallically joined or welded to the end plate by a first explosive charge. A small diameter portion between the collars forms a uniform annular gap within the bore which is expanded over its entire length by a second explosive charge. The second collar, located near the position where the tube emerges from the tube sheet on the nesting side of the tube sheet, is intended to avoid slack between the tube and the tube sheet at the point where the tube emerges. The second collar also is intended to prevent inflation or bulging of the tube beyond the point at which the tube emerges from the tube sheet. In fact, preventing inflation or bulging of the tube beyond the tube face from which it emerges is a consistent object of the prior art explosive welding methods of which we are aware, as further demonstrated, for example, by U.S. Pat. No. 4,117,966 to Green et al. and U.S. Pat. No. 3,426,681 to Oliver.

Accordingly, it is among the objects of the present invention to provide an improved method for explosively welding a tube and tube sheet which eliminates the disadvantages of the known methods. In particular, it is among the objects of the present invention to eliminate the unacceptable gaps around the tubes at the juncture of the tube and tube sheet, but by a method which departs from the prior art in several significant respects, including the expansion of the tube beyond the rear face of the tube sheet from which it emerges as well as significant structural modifications to the rear face of the tube sheet.

SUMMARY OF THE INVENTION

As defined in greater detail hereinafter, a tube sheet, having tube-receiving bores therethrough, has a front face facing outwardly, to which the end of the tube inserted therein is near, and a rear face facing inwardly toward the remaining portion of the tube. In a typical heat exchanger, the front face as referred to herein is disposed toward the heat exchanger head and the rear face is directed toward the internal shell volume of the heat exchanger. The outer diameter of the tube corresponds fairly closely with the inner diameter of the bore through which it is inserted. To facilitate welding, the bore may be tapered or stepped over at least a part of its length so as to form a progressively larger bore diameter at the front face relative to the rear face, although a tapered or stepped bore is not required.

In accordance with the present invention, the rear face of the tube sheet is structurally modified in several significant respects. The rear face of the tube sheet (which forms the bottom of the shell side of a vertically mounted unit) is formed with a slight crown or slope. Further, outlets, or blowdown holes, are spaced around the circumference of the sheet to allow accumulations that are drained to the perimetral region of the tube sheet to be blown down periodically.

Finally, and in a significant departure from the prior art method of which we are aware, the rear face is further modified by trepanning a groove around each of the tube-receiving bores. The inner diameter of each trepanned groove is greater than the diameter of the corresponding bore, thereby forming an integral collar around each bore, the height of which is equal to the depth of the groove. The groove should be less than the thickness of any cladding layer or overlay material that may be applied to the rear face of the tube sheet. Preferably, the tube sheet faces are both overlayed using the same overlay material as the tubes, thus eliminating galvanic attack which may result due to a difference in material.

The outer diameter of each trepanned groove is selected so as to define a circle tangent to the circles defined by the inner diameters of the trepanned grooves around the adjacent bores. Thus, the net effect of the trepanning operation is to cut away substantially the entire surface of the rear face of the tube sheet to the depth of the trepanned grooves, with the exeption of the material remaining to form the collars around each of the bores. Any corrosive material accumulating on the rear face of the tube sheet is prevented by the collars from contacting the junction between the tubes and the tube sheet, thereby decreasing the possibility of corrosion occurring at that junction.

Also in accordance with the present invention, the explosive charge is selected, in a manner known to those skilled in the art, so as to yield an explosive charge sufficient to expand the tube to a point beyond which it emerges from the collar. The collar thus serves to provide support for the tube wall in this region of expansion beyond the (newly-formed since trepanning) rear face of the tube sheet, thus assuring that the tube wall will not weaken in this region due to the explosive expansion.

BRIEF DESCRIPTION OF THE DRAWINGS

For a better understanding of the present invention, the scope of which is set forth in the appended claims, reference is made to the following detailed description of an exemplary embodiment thereof, taken in conjunction with the accompanying drawings, wherein:

FIG. 3 is an enlarged view of the tube of FIG. 1 illustrating in greater detail the regions of explosive welding and expanding over the tube length as contemplated by the present invention.

DETAILED DESCRIPTION OF AN EXEMPLARY EMBODIMENT

Figure 1:
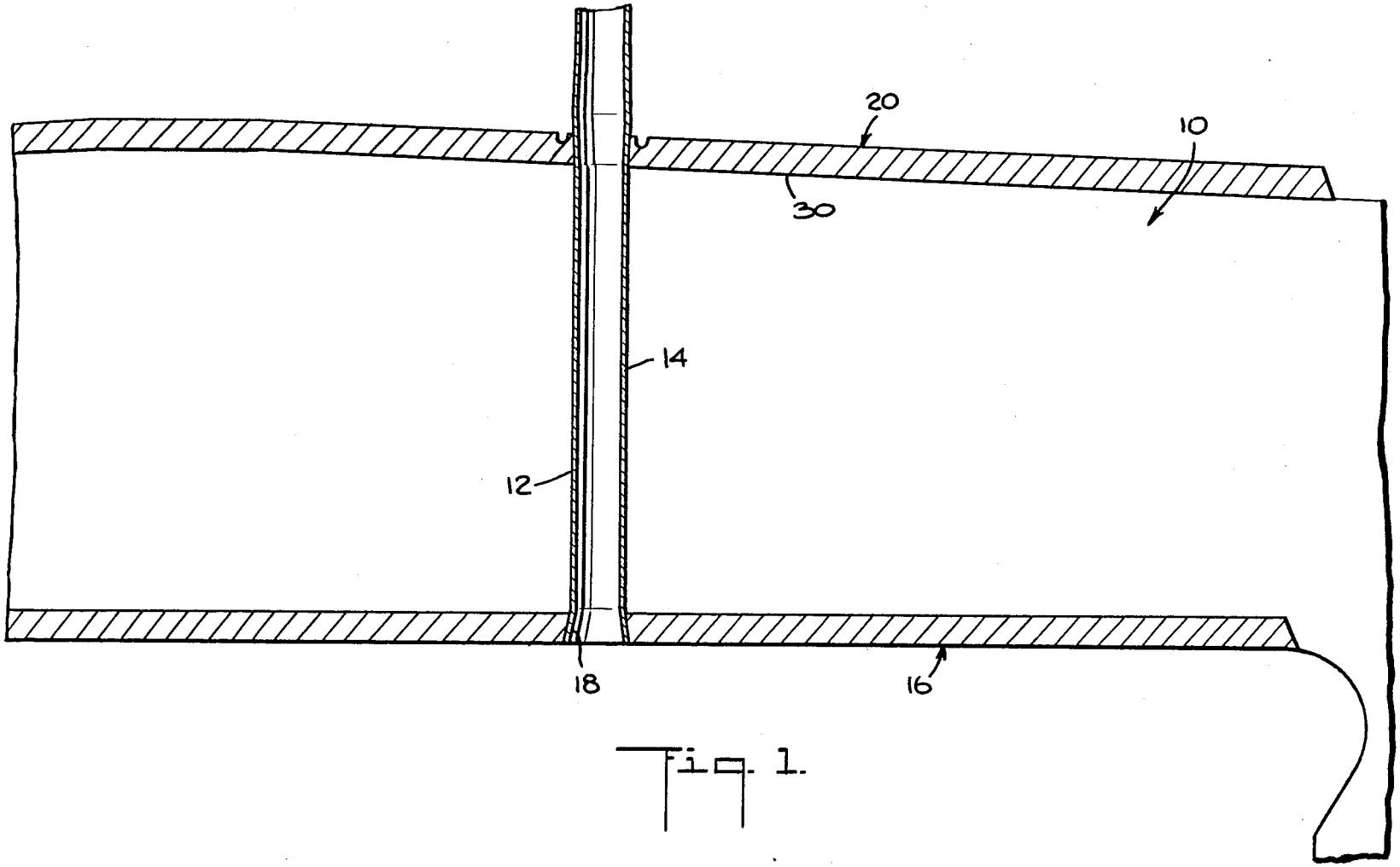
FIG. 1 is a longitudinal section through a single tube located in a tube sheet bore.
Figure 1:
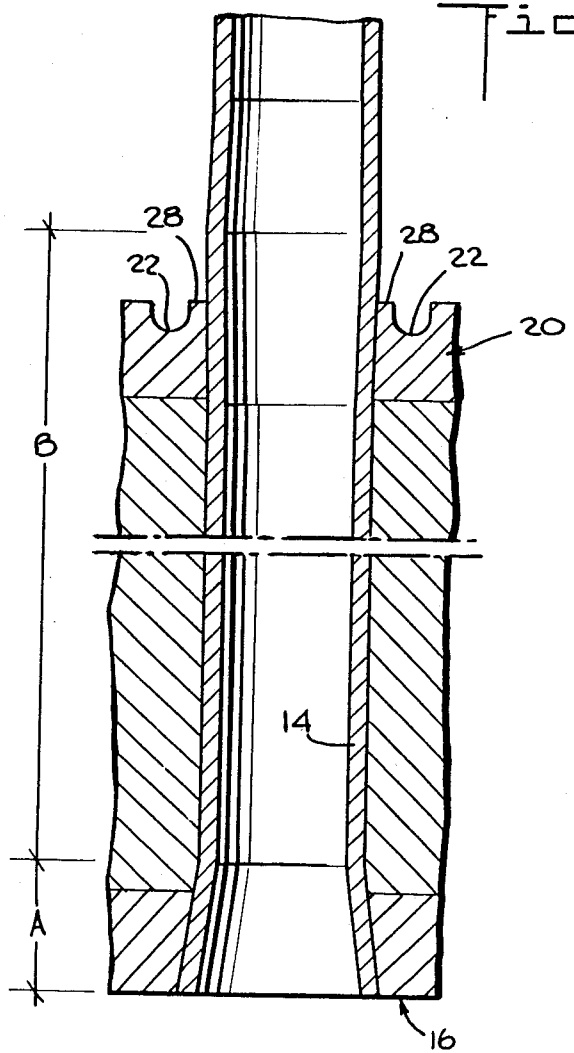

With reference to FIG. 1, there is shown a portion of a tube sheet 10, which for purposes of explanation only is provided with a single bore 12 therethrough, and a tube 14 which is to be explosively welded and expanded to the tube sheet 10, it being appreciated by those skilled in the art that such a tube sheet would have many such bores and tubes. For example, such a tube sheet typically may be provided with as many as over 700 ⅝" O.D. U-Tubes on a triangular pitch arranged symmetrically about vertical and horizontal centerlines. The tube sheet 10 has a front face 16 facing outwardly near the end 18 of the tube 14, and a rear face 20 facing inwardly toward the remaining portion of the tube 14. In a typical heat exchanger, the front face 16 is disposed toward the heat exchanger head, and the rear face 20 is directed toward the internal shell volume of the heat exchanger. The outer diameter of the tube 14 corresponds fairly closely with the inner diameter of the bore 12 by closely controlling tube sheet bore drilling/reaming tolerance and tube outside diameters, in, manners known to those skilled in the art. It will also be appreciated by those skilled in the art that to facilitate welding the bore 12 may be tapered, as illustrated in FIGS. 1 and 3 herein, or stepped, so as to form a progressively larger bore diameter at the front face 16 relative to the rear face 20 of the tube sheet 10 to minimize tube inlet problems, although such tapering or stepping is not a necessary aspect of the present invention.

The rear face 20, which forms the bottom of the shell side of a vertically mounted unit, is formed with a slight crown or slope, e.g., a ½" pitch over the radius of the tube sheet, to provide drainage to the perimeter of the tube sheet. Blowdown holes, spaced around the circumference of the rear face 20, allow accumulations that are drained to the perimetral region of the rear face 20 to be blown out periodically.

Figure 2:
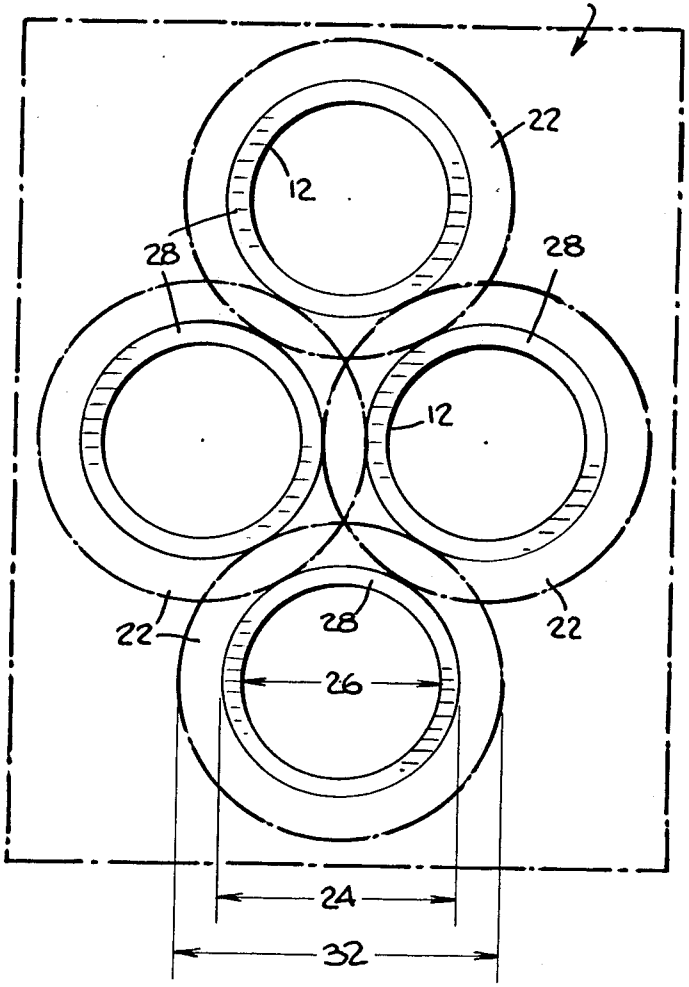
FIG. 2 is a plan view of a portion of a rear face of a tube sheet illustrating trepanned annular grooves around several tube-receiving bores in accordance with the present invention.

In a significant departure from the prior art of which we are aware, the rear face 20 is further modified by trepanning a groove 22 in the face of the tube sheet around the bore 12. As illustrated more clearly in FIG. 2, the inner diameter 24 of each trepanned groove 22 is greater than the diameter 26 of the corresponding bore 12, thereby forming an integral collar 28 around the bore 12. The height of the collar 28, therefore, is equal to the depth of the groove 22 (which should be less than the thickness of any overlay or cladding layer 30 (FIG. 1) that may be applied to, or as, the rear face 20 of the tube sheet 10).

The outer diameter 32 of each groove 22 preferably is selected so that the grooves around adjacent bores intersect each other and most preferably is selected so as to define a circle tangent to the circles defined by the inner diameters 24 of the grooves 22 around the adjacent bores 12. Thus, the net effect of the trepanning operation is to cut away substantially the entire surface of the rear face 20 of the tube sheet 10 to the depth of the grooves 22, i.e., except for the material remaining to form the collars 28 around each of the bores 12, as indicated by the dash-dot portions of the outer groove circles in the region of FIG. 2 where the circles intersect. Thus, any material accumulating on the (newly-formed since trepanning) rear face 20 of the tube sheet 19 is prevented by the collars 28 from contacting the junction between the tubes 14 and the tube sheet 10, and the possibility of corrosion occurring at that junction is thereby decreased. Because the grooves intersect, the accumulated material is easily flushed to perimetral blowdown holes during periodic blow down cleanings.

As previously noted, it is an aim of the tube to tube sheet welding methods of which we are aware to avoid expanding the walls of the tube beyond the point at which the tube emerges from the rear face of the tube sheet. I.e, the expanded portion of the tube should reside completely between the front face and the rear face of the tube sheet. However, with reference now to FIG. 3, in accordance with the present invention the explosive charge is selected in a manner known to those skilled in the art so as to weld explosively the tube 14 to the tube sheet 10 in a region A adjacent to the front face 16 of the tube sheet, and to expand the tube 14 explosively, so as only to make contact with, but not to deform plastically against, the walls of the bore 12, over a region B which extends within the tube sheet proper from region A to a point beyond the rear face 20 of the tube sheet, i.e., to a point immediately beyond the point at which the tube 14 emerges from the collar 28. By expanding the tube in region B so that it only contacts the walls of the bore, along with closely controlling the tolerances of the tube and bore, the expanded tubes have regional stresses less severe than those fixed to a tube sheet by other methods.

By extending the expansion of the tube 14 beyond the collar 28, any gap or crevice between the outer surface of the tube 14 and the inner surface of the bore 12 is eliminated. The collar 28, integrally formed from the material of the tube sheet 10, provides a "yieldable"

support for the tube wall to bulge or expand in the expansion region B surrounded by the collar 28 (beyond the newly-formed rear face 20 of the tube sheet), thus assuring that the tube wall will not weaken beyond the rear face 20 due to the explosive expansion. Such weakening has been a primary concern in the prior art methods, and thus a reason for avoiding such further expansion beyond the rear face.

While the present invention has been described in detail with reference to an exemplary embodiment thereof, it will be appreciated by those skilled in the art that variations and modifications may be made thereto without departing from the spirit of the inventive concepts disclosed herein. All such variations and modifications are intended to fall within the scope of the appended claims.

We claim:

1. In a method for explosively welding and expanding a tube to a tube sheet, comprising the steps of locating said tube in a bore formed in said tube sheet for accommodating said tube, said bore extending completely through said tube sheet from a front face to a rear face thereof, such that an end of said tube is near said front face and a remaining portion of said tube projects inwardly through said tube sheet and emerges beyond said rear face, positioning an explosive means selected to yield, a predetermined explosive force when detonated, in said tube at a location near said front face of said tube sheet, and detonating said explosive means so that the resulting detonation welds at least a first region of said tube within said bore near said front face and expands a second region of said tube within said tube sheet farther remote from said front face than said first region, the improvement comprising the additional steps of trepanning an annular groove, having an inner diameter greater than the diameter of said bore, in said rear face of said tube sheet around said bore so as to form an integral annular collar around said bore, and selecting said explosive charge so as to yield a predetermined explosive force sufficient to expand said tube such that said second region extends from said first region to a point immediately beyond a point at which said tube emerges from said annular collar

2. The method according to claim 1, wherein said annular collar has a height equal to the depth of said annular groove.

3. The method according to claim 1, wherein a plurality of tubes are fastened to said tube shell in a corresponding plurality of bores, and wherein each trepanned annular groove intersects the trepanned annular grooves around adjacent bores.

4. The method according to claim 1, wherein a plurality of tubes are fastened to said tube sheet in a corresponding plurality of bores, and wherein each trepanned annular groove has an outer diameter that defines a circle tangent to the circles defined by the inner diameters of the trepanned annular groove around adjacent bores.

5. The method according to any of claims 1, 2, 3 or 4, wherein said rear face is provided with a cladding layer and said annular groove has a depth less than the thickness of said cladding layer.

6. In a combination comprising a tube and a tube sheet to which said tube is to be explosively welded and expanded, wherein said tube sheet has a bore formed therein extending from a front face to a rear face of said tube sheet, said tube inserted in said bore such that a first end thereof is near said front face and a remaining portion of said tube extends through said tube sheet and emerge beyond the rear face of said tube sheet, and wherein an explosive means selected to yield a predetermined explosive force when detonated is located within said tube near said front face and which, when detonated, explosively welds said tube within said bore in a first region near said front face and expands said tube within said bore in a second region of said tube within said tube sheet farther remote from said front face than said first region, the improvement wherein, an annular groove, having an inner diameter greater than the diameter of said bore, is cut in said rear face around said bore, thereby forming an integral annular collar around said bore, and said predetermined explosive force expands said tube such that said second region extends from said first region to a point immediately beyond a point at which said tube emerges from said annular collar.

7. The combination according to claim 6, wherein said annular collar has a height equal to the depth of said annular groove.

8. The combination according to claim 6, wherein a plurality of tubes are to be explosively welded and expanded to said tube sheet in a corresponding plurality of bores, and wherein each annular groove around each bore has an outer diameter that defines a circle tangent to the circle defined by the inner diameters of the annular grooves around adjacent bores.

9. The combination according to claim 6, and further comprising a cladding layer of a predetermined thickness on said rear face of said tube sheet.

10. The combination according to claim 9, wherein said annular groove has a depth less than the thickness of said cladding layer.

11. The combination according to any of claims 6, 7, 8, 9 or 10, wherein said rear face is formed with a crown to provide drainage to a perimetral region of said tube sheet, and further comprising drainage means in said tube sheet located in said perimetral region.

* * * * *

UNITED STATES PATENT AND TRADEMARK OFFICE

CERTIFICATE OF CORRECTION

PATENT NO. : 4,749,117

DATED : 7 June 1988

INVENTOR(S) : Renato R. NOE et al.

It is certified that error appears in the above-identified patent and that said Letters Patent is hereby corrected as shown below:

Column 6, line 3: change "groove" to --grooves--.

Column 6, line 17: change "emerge" to --emerges--.

Signed and Sealed this

Twenty-fifth Day of October, 1988

*Attest:*

DONALD J. QUIGG

*Attesting Officer*

*Commissioner of Patents and Trademarks*